United States Patent [19]

Rao et al.

[11] Patent Number: 4,566,318

[45] Date of Patent: Jan. 28, 1986

[54] METHOD FOR OPTIMIZING THE TRIPPING VELOCITY OF A DRILL STRING

[75] Inventors: M. Vikram Rao; John E. Fontenot, Jr., both of Houston, Tex.

[73] Assignee: NL Industries, Inc., New York, N.Y.

[21] Appl. No.: 595,284

[22] Filed: Mar. 30, 1984

[51] Int. Cl.[4] ..... E21B 45/00

[52] U.S. Cl. ..... 73/151; 73/151.5; 175/48

[58] Field of Search ..... 73/151, 151.5; 175/48

[56] References Cited

U.S. PATENT DOCUMENTS 3,910,110 10/1975 Jeffries et al. ..... 175/48

4,510,797 4/1985 Guidry et al. ..... 73/151

*Primary Examiner*—Howard A. Birmiel

*Attorney, Agent, or Firm*—Browning, Bushman, Zamecki & Anderson

[57] ABSTRACT

The present invention is directed to a method for optimizing the tripping velocity of a drill string. The method of the present invention comprises determining the hydraulic fluid pressure in the borehole in a plurality of intervals as the drill string is pulled out of or run into the borehole. These actual pressures are compared against a predetermined acceptable pressure range for each interval. The limits for this acceptable pressure range are set by the maximum acceptable surge pressures and the minimum acceptable swab pressures established for the interval. The velocity of the drill string in each such interval is then adjusted in order to maximize the tripping velocity while maintaining the hydraulic fluid pressure within the acceptable range for each interval. In fact, the velocity is preferably adjusted to maintain the fluid pressure near the maximum acceptable surge pressure while the drill string is being run into the borehole and to maintain the fluid pressure near the minimum acceptable swab pressure while the drill string is being pulled out of the borehole.

20 Claims, No Drawings

METHOD FOR OPTIMIZING THE TRIPPING VELOCITY OF A DRILL STRING

BACKGROUND OF THE INVENTION

1. Field of the Invention

The present invention generally relates to a method for optimizing the tripping velocity of a drill string. The present invention is particularly useful for maximizing the efficiency of a drilling operation while maintaining the hydraulic pressure of the drilling fluid in the borehole within an acceptable range. More particularly, the present invention maximizes the velocity at which a drill string may be run into or pulled out of a borehole while not producing surge or swab pressures which are outside a desired safety range.

2. Description of the Background

Rotary drilling operations employ a drill bit for cutting into earth formations to produce a borehole. The drill bit is affixed to the end of a drill string, comprising a plurality of coupled together pipe joints, each about 30 feet in length. Additional pipe joints are added to the drill string as drilling progresses.

During the drilling operation, it is often necessary to remove the drill string in order to change the drill bit. It may also be necessary to remove the drill string for other reasons, such as to perform desired logging operations. After the bit is changed or after such logging operations are completed, the drill string must be reconstructed and returned to the borehole. The process of pulling out and running in the drill string, known as "tripping", is well known in the industry. Tripping is a tolerated and necessary evil which must be completed in as short a time as possible; there is no progress being made in completing the drilling operation during the tripping procedure, resulting in the loss of valuable rig time.

Although pipe joints may be added or removed individually, in order to save time and maximize the efficiency of the drilling rig, it is a general practice to add or remove pipe sections during tripping operations in interconnected lengths of two or three pipe joint sections. These sections are known, respectively, as "doubles" or "trebles" and are often collectively referred to as "stands." Such interconnected stands are normally stored vertically in pipe stands or racks on or near the drilling rig.

In a typical tripping operation, a double or treble pipe stand will be pulled out of or run into the borehole through the rotary table of the drilling rig by use of a vertically movable traveling block in the rig derrick. The double or treble stand is disconnected or connected just above the floor of the drilling rig while the drill string remaining in the borehole is firmly grasped by slips in the rotary table. This operation is continued sequentially until the entire drill string has been pulled out of the borehole or until the drill string has been run into the borehole so that the drilling bit has been lowered into contact with the bottom of the borehole. The operation of pulling out or running in the drill string thus occurs in a plurality of pulls or runs wherein the pipe is accelerated from a stationery position to a pulling or running speed and then decelerated to another stationery position, generally in 60–90 foot intervals. The running or pulling speed is generally constant over substantially the entire length of each of these stepped intervals.

A drilling fluid, commonly known as drilling mud, is continuously circulated down the drill string and up the annulus formed by the drill string and the borehole in order to maintain sufficient pressure in the borehole to impede the entrance of formation fluids into the borehole in order to prevent a well "blowout". It is desirable to maintain the hydrostatic pressure of the static drilling fluid column in the well in balance with the bottomhole formation pressure. However, while a pipe string is being pulled out or run into a borehole, a variety of hydraulic effects create pressure differentials in the drilling fluid relevant to the hydrostatic borehole pressure.

Surging or "surge pressure" involves an increase in the total hydraulic pressure in the borehole to a pressure greater than the normal hydrostatic pressure for the static drilling fluid column in the well. This condition often occurs when the drill string is being run into the borehole at an excessive speed. Excessive surge pressure may result in damage to the surrounding formation, even producing undesirable fractures in the formation. Such fractures may result in the loss of drilling fluid, sticking of the drill pipe and other undesirable results.

Another hydraulic effect, swabbing, may also be produced. Swabbing or "swab pressure" involves a reduction in the total hydraulic pressure in the borehole to a pressure less than the normal pressure for the hydrostatic pressure of the static drilling fluid column in the well. This condition often occurs when the drill string is being pulled out of the borehole at an excessive speed. Such excessive reduction in the hydraulic pressure may result in formation fluids entering the borehole in a condition known as "kick". Additional reduction of the hydraulic pressure may result in an uncontrolled kick or blowout. Further, in soft formations, excessive swabbing may result in collapse of the borehole walls.

Accordingly, it is necessary to minimize the swab and surge pressures associated with pulling out the drill string or with running in the drill string during the tripping operation. However, because the tripping operation is non-productive, it is also desirable to maximize the speed with which these operations are performed so that the down time of the drilling rig is minimized and the efficiency of the rig is maximized. Commonly, a tripping schedule or listing providing suggested optimal tripping velocities per stand is available to the driller. The driller then attempts to pull out or run in the stands of the pipe string at the suggested uniform velocity by noting the total time required for moving each stand of pipe. However, these suggested tripping velocities do not provide maximized velocities per stand in order to minimize the total tripping time while maintaining the drilling fluid pressure within acceptable limits. Accurate and maximized tripping velocities are actually affected by many factors. The maximum, safe velocity may be effected by the amount of moving pipe in a hole, by the depth to which the pipe extends and by the characteristics and pressures of the formations through which the borehole has progressed.

Others have attempted to solve this problem by merely establishing maximum tripping velocities which should not be exceeded and by monitoring the actual tripping velocity to sound a warning signal if the established maximum velocity is exceeded. See the velocity measurement and warning system disclosed by Smith in U.S. Pat. Nos. 3,866,468 and 3,942,594. Others have attacked this problem by determining the volume, and hence the weight or mass, of drilling fluid required to fill the borehole as pipe is pulled out or of drilling fluid displaced from the borehole as pipe is run in. See the comparison system of Leonard disclosed in U.S. Pat. Nos. 3,646,808 and 3,729,986.

However, these efforts have not resulted in a solution to the long felt but unresolved need for a method for optimizing the tripping velocity of a drill string by maximizing the tripping velocity while maintaining the hydraulic pressure of the drilling fluid within an acceptable range.

SUMMARY OF THE INVENTION

The present invention provides a new and improved method for optimizing the tripping velocity of a drill string. This method is particularly useful in maximizing the tripping velocity of the drill string while maintaining the hydraulic pressure of the drilling fluid in the borehole within an acceptable range. The present method permits the tripping velocity to be maximized while monitoring the hydraulic pressure of the drilling fluid in the borehole to maintain the well pressure within an acceptable range.

In the present method, the fluid pressure near the drill bit is determined at a plurality of locations in the borehole during the tripping operation. Additionally, the velocity of the drill string in a plurality of corresponding intervals in the borehole is determined during the tripping operation. An acceptable fluid pressure range having a minimum and maximum acceptable fluid pressure is established for each of these locations within the borehole. The actual, determined fluid pressure at each of these locations is compared with the corresponding acceptable fluid pressure range. During subsequent tripping operations, the tripping velocity in each interval is adjusted to maximize the tripping velocity while maintaining the determined pressure within the acceptable fluid pressure range. This method may employ determination and comparison of surge pressures, swab pressures or both. This method may employ pressure determinations made while the drill string is being pulled out of the borehole, run into the borehold, or during both procedures of the tripping operation. This method may employ pressure determinations made during the movement of each stand of pipe or it may employ determinations made during any lesser number of connections. Furthermore, those skilled in the art will appreciate that such a method, when computer controlled, could continuously monitor pressure while the drill string is both moving and stationary to provide continuous adjustment.

The present invention provides a method to optimize or maximize the tripping velocity of a drill string while maintaining the hydraulic pressure of the drilling fluid in the borehole within an acceptable range in order to maximize the efficiency of the drilling operation.

DETAILED DESCRIPTION OF THE PREFERRED EMBODIMENT

The present invention comprises a method for optimizing the velocity of a drill string during the tripping operation. The present invention is directed to maximizing the incremental velocities attained by the drill string over the plurality of intervals during which it is separately accelerated during tripping while maintaining the hydraulic pressure of the drilling fluid near the drill bit within an acceptable range. This acceptable range of hydraulic pressure is established in order to prevent excessively high surge pressures and dangerously low swab pressures. As explained in the background, excessively high surge pressures may result in a variety of problems, including unwanted fracturing of the formation and loss of drilling fluid. Further, excessively low swab pressures may result in a variety of other problems, including collapse of the borehole, invasion of formation fluid and ultimately blowout conditions.

The method of the present invention begins with determining the hydraulic pressure of the drilling fluid near the drill bit at a plurality of locations in the borehole. These determinations may be made during tripping, during drilling or while pipe stands are being connected or disconnected to the drill string. These determinations are made with any conventional pressure measurement device useful in a measurement while drilling environment. These determinations may be made by direct or indirect measurement of pressure. Either a single measurement or a plurality of measurements may be made at each location. It is presently preferred to make only a single measurement at each location or during each interval. However, in an alternative embodiment, it is contemplated that a plurality of measurements, e.g., five, may be made in each interval and at different velocities in order to provide more data for more accurate and better optimization. In fact, it is also contemplated that where a plurality of determinations are made in any interval, the data may be processed downhole and only the minimum and maximum pressures recorded or transmitted for comparison. These determinations may be made at any desired interval as the drill string is being pulled out of or run into the borehole. In fact, with appropriate measurement equipment and computer control, it is contemplated that these determinations may be continuously made if desired. These determinations may be made during either the pulling out or the running in of the drill pipe or during both phases of the tripping operation. Further, these determinations may be made during every tripping operation to most efficiently maximize the correction and tripping velocities or these determinations may be made during only certain tripping operations as desired by the operator. The measured fluid pressures or other data may be transmitted to the surface for recording by an operator or storage in a computer or other data handling device. Alternatively, the pressures or other data measured during each tripping operation may be stored in an appropriate storage device located at or near the pressure sensing device in the drill string and the data recovered for analysis and comparison when the sub containing this storage device is tripped to the surface.

The method of the present invention further includes the step of determining the velocity of the drill string in a plurality of intervals corresponding to the pressure determination intervals in the borehole during the tripping operation. The tripping velocities are most conveniently determined at the surface where pipe movement can be readily observed and the data easily recorded or stored for analysis. Means for measuring the tripping velocity in these intervals are well known to the art. Any appropriate means, such as that disclosed by Smith in U.S. Pat. Nos. 3,866,468 and 3,942,594 may be employed to determine the instantaneous and average tripping velocities during the measured intervals.

The method further comprises the step of determining and establishing maximum and minimum acceptable hydraulic fluid pressures for each of said intervals in the borehole. These fluid pressures will establish an acceptable hydraulic fluid pressure range. It is desirable that the surge pressure not exceed a maximum acceptable hydraulic fluid pressure in order to prevent damage to the formation and other problems associated with excessively high pressures. Furthermore, it is desirable that the swab pressure not decrease below a minimum acceptable level to ensure that formation fluids do not invade the borehole and more importantly to assure that blowout conditions do not develop. The acceptable hydraulic fluid pressure range for each interval may be established based upon prior knowledge developed or obtained by standard logging techniques concerning the formation, such as knowledge concerning the lithology and other characteristics of the formation near these intervals.

The method of the present invention further comprises the step of comparing the actually determined, hydraulic fluid pressure for each interval with the acceptable fluid pressure range for that interval. This comparison may be performed manually or visually by an operator, although it is preferred that this comparison be performed automatically by an appropriate digital or analog computer or other means. By comparing this pressure data for the determined velocities and knowing that as the tripping velocity increases the surge pressure increases and the swab pressure decreases, the operator can maximize the tripping velocity while maintaining the fluid pressure within the acceptable range.

Finally, the present invention comprises the step of adjusting for subsequent trips, the tripping velocity in each of the measured intervals in order to maximize the tripping velocity while maintaining the actual, determined pressure within the acceptable hydraulic fluid pressure range for each interval. In fact, it is most desirable to maintain the tripping velocity at its maximum level while maintaining the surge pressure near its maximum acceptable level while running the drill string into the borehole. Further, it is most desirable to maintain the tripping velocity at its maximum level while maintaining the swab pressure near its minimum acceptable level while pulling the drill string out of the borehole. Although these operations may be performed manually, it is preferred that the comparison of pressures and adjustment of tripping velocities be performed automatically, such as by a computer or other device.

The foregoing description of the invention has been directed in primary part to a particular preferred method in accordance with the requirements of the patent statutes and for purposes of explanation and illustration. It will be apparent, however, to those skilled in the art that many modifications and changes in the specifically described method may be made without departing from the scope and spirit of the invention. For example, the pressure may be determined either directly or indirectly by any appropriate means known to those skilled in the art. Therefore, the invention is not restricted to the particular method described, but covers all modifications which may fall within the scope of the following claims.

It is Applicants' intention in the following claims to cover such modifications and variations as fall within the true spirit and scope of the invention.

What is claimed is:

1. A method for optimizing the tripping velocity of a drill string useful to increase the efficiency of a drilling operation while maintaining the hydraulic fluid pressure of the drilling fluid in the borehole within an aceptable range, comprising:

measuring during tripping the hydraulic fluid pressure of the drilling fluid in the borehole near the drill bit in a plurality of intervals longitudinally spaced along the borehole;

measuring the tripping velocity of the drill string in said intervals;

comparing said measured fluid pressure for each of said intervals in the borehole with predetermined acceptable fluid pressure ranges for each corresponding interval; and adjusting for subsequent trips the tripping velocity in each of said intervals in order to maximize the tripping velocity while maintaining the measured pressure within the acceptable fluid pressure range for each interval.

2. The method of claim 1 comprising measuring said pressures and velocities during a tripping operation.

3. The method of claim 1 comprising adjusting the tripping velocity in each interval so that the measured fluid pressure in each interval is always maintained within the acceptable fluid pressure range.

4. The method of claim 1 comprising measuring surge pressures.

5. The method of claim 4 comprising measuring said surge pressures while said drill string is being run into the borehole.

6. The method of claim 4 comprising adjusting the tripping velocity to minimize the difference between the measured fluid pressure and the maximum acceptable pressure for each interval.

7. The method of claim 1 comprising measuring swab pressures.

8. The method of claim 7 comprising measuring said swab pressures while said drill string is being pulled out of the borehole.

9. The method of claim 7 comprising adjusting the tripping velocity to minimize the difference between the measured fluid pressure and the minimum acceptable pressure for each interval.

10. The method of claim 1 comprising directly measuring said fluid pressures in each interval.

11. The method of claim 1 comprising indirectly measuring said fluid pressures in each interval.

12. The method of claim 1 comprising comparing said measured fluid pressure with said acceptable pressure range for each interval automatically by computer means.

13. The method of claim 12 comprising adjusting said velocities automatically by computer means.

14. The method of claim 13 comprising measuring said pressures and velocities and adjusting said velocities continuously.

15. The method of claim 1 comprising storing data corresponding to said measured pressures in a storage means in the drill string while said drill string is in the borehole and retrieving said stored data from said storage means when the drill string is pulled out of the borehole.

16. The method of claim 1 comprising measuring said pressures as the drill string is being pulled from the borehole during the tripping operation.

17. The method of claim 1 comprising moving said drill string through the borehole at a plurality of velocities in each interval and measuring the hydraulic pressure corresponding to each velocity in each interval.

18. The method of claim 17 comprising comparing only the minimum and maximum recorded pressures for each interval with said acceptable fluid pressure range.

19. The method of claim 1 further comprising establishing said predetermined acceptable fluid pressure ranges by detecting the influx of formation fluids into the borehole in each said interval and by detecting the loss of drilling fuid from the borehole in each said interval.

20. The method of claim 1 further comprising establishing said predetermined acceptable fluid pressure ranges as formation pore pressures and formation fracture pressures in each said interval.

* * * * *